United States Patent [19]

Nicodemus

[11] Patent Number: 4,545,739

[45] Date of Patent: Oct. 8, 1985

[54] START-UP FOR HYDROKINETIC AMPLIFIER

[75] Inventor: Carl D. Nicodemus, Caledonia, N.Y.

[73] Assignee: Helios Research Corp., Mumford, N.Y.

[21] Appl. No.: 538,148

[22] Filed: Oct. 3, 1983

Related U.S. Application Data

[63] Continuation-in-part of Ser. No. 517,821, Jul. 27, 1983, abandoned, which is a continuation-in-part of Ser. No. 236,918, Feb. 23, 1981, abandoned, which is a continuation-in-part of Ser. No. 42,967, May 29, 1979, abandoned.

[51] Int. Cl.[4] ..... F04F 9/00

[52] U.S. Cl. ..... 417/152; 417/151

[58] Field of Search ..... 417/151, 152, 182

[56] References Cited

U.S. PATENT DOCUMENTS

| | | | |
|---|---|---|---|
| 118,734 | 9/1871 | Mack . | |
| 129,491 | 7/1872 | O'Rorke . | |
| 697,770 | 4/1902 | Allen . | |
| 929,674 | 8/1909 | Koerting | 417/198 |
| 944,455 | 12/1909 | Metcalfe et al. . | |
| 2,046,887 | 7/1936 | Walch . | |
| 2,369,692 | 2/1945 | Tinker . | |
| 3,625,820 | 12/1971 | Gluntz et al. | 417/151 X |

OTHER PUBLICATIONS

*Marks' Standard Handbook for Mechanical Engineers*, 8th Edition, McGraw-Hill Book Company, pp. 14–14, 14–15.

"Operating Guide for Sellers Hydraulic Jet Cleaners Models B, BX and BZ", Bulletin 420-E.

"Low Level Condensers-Eductor and Multi-Jet Type", Bulletin 5AB, Ametek, Schutte & Koerting Division, 1980.

*Primary Examiner*—Stephen F. Husar

*Attorney, Agent, or Firm*—Stonebraker, Shepard & Stephens

[57] ABSTRACT

Several expedients can start-up a hydrokinetic amplifier powered by operating vapor at subatmospheric pressure. One expedient connects an evacuated region to the discharge region of suction chamber 13 so that subatmospheric pressure vapor flows through vapor input nozzle 12 and into the suction chamber. At this time, liquid admitted through nozzle 11 forms a free liquid jet 20 so that vapor impinges on and condenses in jet 20. Once the collapse of condensing vapor produces a suction in chamber 13, the amplifier starts and the evacuated region disconnects from chamber 13. By another expedient, super atmospheric pressure vapor is condensed in jet 20 to establish a suction, whereupon the vapor supply is switched to subatmospheric pressure operating vapor that is drawn in by the suction produced by collapse of the start-up vapor. Another expedient uses high pressure liquid to produce a low pressure entrainment jet for drawing subatmospheric pressure operating vapor into suction chamber 13. As the vapor condenses in jet 20, its collapse lowers the suction pressure within chamber 13, whereupon a valve 41 switches from start-up liquid to lower pressure operating liquid.

8 Claims, 2 Drawing Figures

START-UP FOR HYDROKINETIC AMPLIFIER

RELATED APPLICATIONS

This application is a continuation-in-part of my copending patent application Ser. No. 517,821, filed July 27, 1983, now abandoned, and entited HYDROKINETIC AMPLIFIER, which parent application is a continuation-in-part of grandparent application Ser. No. 236,918, filed Feb. 23, 1981, entitled HYDROKINETIC AMPLIFIER, which grandparent application was a continuation-in-part of my great grandparent application Ser. No. 042,967, filed May 29, 1979, entitled FLUID PRESSURE AMPLIFIER AND CONDENSER. Both my grandparent and great grandparent applications were abandoned upon filing of successor applications, and the full disclosure of both my parent application Ser. No. 517,821 and my grandparent application Ser. No. 236,918 is hereby incorporated into this continuation-in-part application.

BACKGROUND

My hydrokinetic amplifier as disclosed in my parent application advances the art of combining the energies of a liquid and a condensable vapor. It reduces losses from fluid friction, increases the speed and efficiency of condensing the vapor, and increases the momentum transfer from vapor to liquid. This results in a surprisingly large pressure amplification that can exceed the sum of the absolute liquid and vapor input pressures by a factor of four.

As vapor condenses in liquid flowing within my hydrokinetic amplifier, it collapses and produces a suction that draws in more vapor. The suction produced by condensing vapor can be well below atmospheric pressure so that my hydrokinetic amplifier can draw in and operate with vapor from a subatmospheric pressure source. The suction can also draw in liquid from a subatmospheric pressure source, even while subatmospheric pressure vapor provides the motive power.

This ability to draw in operating vapor from a subatmospheric pressure source without using a pump or other external energy is valuable in eductive condensation. My hydrokinetic amplifier can operate as a low pressure, eductive condenser by using energy from the vapor being condensed, even though that vapor is at subatmospheric pressure.

Start-up for operating my hydrokinetic amplifier with subatmospheric pressure vapor requires ways of initiating inflow of liquid and vapor to begin condensing vapor so as to create a low pressure suction that draws in vapor to sustain operation. I have discovered ways of accomplishing this so that my hydrokinetic amplifier can be started easily and effectively and then continue running under the motive power supplied by a subatmospheric pressure vapor.

SUMMARY OF THE INVENTION

My start-up methods and system apply to a hydrokinetic amplifier powered by operating vapor at subatmospheric pressure. A suitable hydrokinetic amplifier has: a suction chamber with an input region and a discharge region; a liquid input nozzle arranged in the input region for directing a free liquid jet into the suction chamber; a vapor input nozzle arranged in the input region for directing a vapor into the suction chamber to surround and impinge on the liquid jet; and a converging amplifier nozzle and diverging diffuser arranged downstream of the suction chamber. Such a hydrokinetic amplifier can be used as an eductive condenser drawing in subatmospheric pressure vapor to be condensed and deriving operating power from the vapor itself.

In one preferred way of starting such a hydrokinetic amplifier, I connect an evacuated region to the discharge region of the suction chamber while the suction chamber is in communication with the source of subatmospheric pressure operating vapor so that vapor flows through the vapor input nozzle and into the suction chamber. I then admit liquid to the liquid input nozzle to form a free liquid jet extending through the suction chamber while the operating vapor is flowing so that the vapor impinges on and condenses in the liquid jet. I disconnect the evacuated region from the suction chamber once the condensing vapor produces a pressure in the suction chamber lower than the subatmospheric pressure of the operating vapor. My amplifier then continues to run by drawing in its operating vapor.

I can also start up a hydrokinetic amplifier for operating on subatmospheric pressure vapor by first flowing super atmospheric pressure vapor into the vapor nozzle. I flow liquid into the liquid input nozzle at the same time so that the start-up vapor impinges on and condenses in the free liquid jet to produce a pressure in the suction chamber lower than the subatmospheric pressure of the operating vapor. Then I change from super atmospheric pressure start-up vapor to subatmospheric pressure operating vapor that is drawn into the suction chamber to sustain operation.

I can also start up a hydrokinetic amplifier for operation on subatmospheric pressure vapor by directing pressurized liquid through the input nozzle to form a start-up liquid jet with sufficient velocity to produce a pressure in the suction chamber lower than the subatmospheric pressure of the operating vapor. Then I can admit operating vapor to be entrained into the suction chamber by the high velocity liquid jet so that the vapor impinges on and condenses in the start-up jet to lower the pressure in the suction chamber. Then I can reduce the input liquid pressure to a lower operational pressure to form a free liquid jet powered by subatmospheric pressure vapor.

DRAWINGS

FIG. 1 is a schematic diagram of one preferred embodiment of a start-up system for operating my hydrokinetic amplifier with subatmospheric pressure vapor; and FIG. 2 is a schematic diagram showing alternative ways of starting up my hydrokinetic amplifier for operation on subatmospheric pressure vapor.

DETAILED DESCRIPTION

Figure 1:
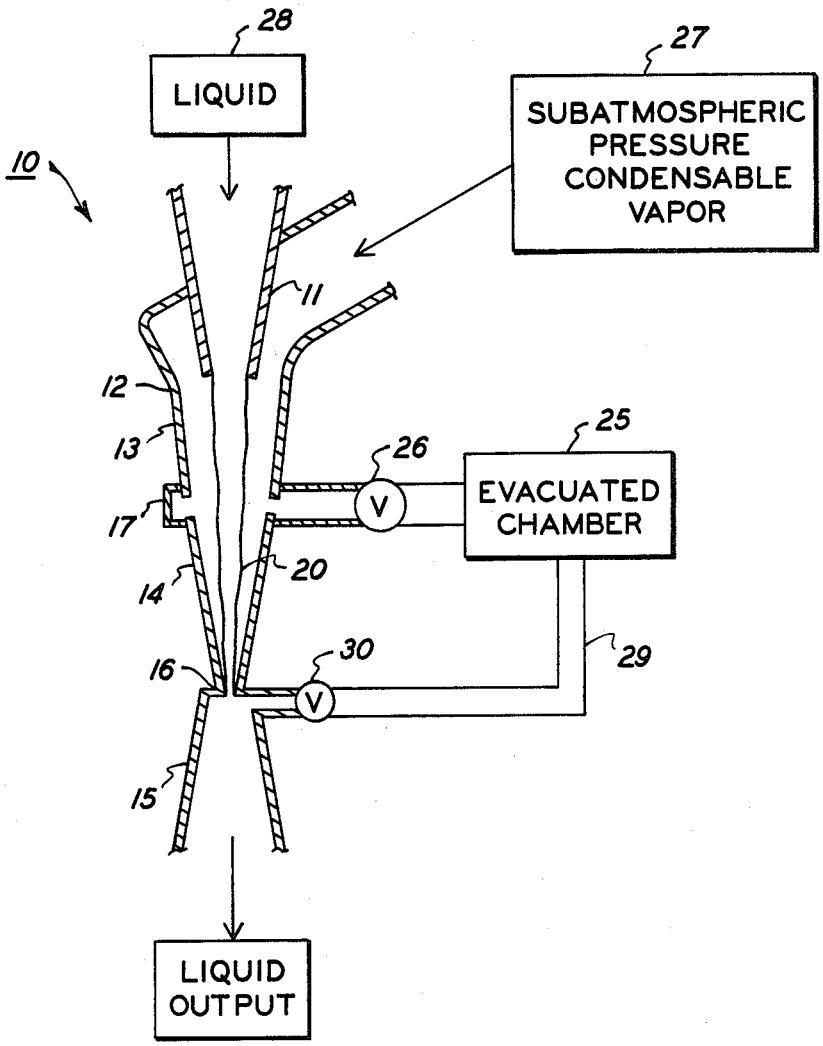

As explained fully in my parent application, my hydrokinetic amplifier 10 includes a liquid input nozzle 11, a vapor nozzle 12, a suction chamber 13, a converging amplifier nozzle 14, and a diffuser 15. Liquid nozzle 11 forms a free liquid jet 20 that extends through suction chamber 13 to a region where it impinges on the converging wall of amplifier nozzle 14 near its minimum cross-sectional area or R area 16.

The main function of liquid input nozzle 11 is to form and direct free liquid jet 20 to extend through suction chamber 13 and into amplifier nozzle 14. Nozzle 11 is preferably a converging liquid nozzle with a discharge area 21 that determines the size and flow rate of jet 20 for a given liquid input pressure. Nozzle 11 is also preferably coaxial with suction chamber 13, amplifier nozzle 14, and diffuser 15 and is aimed so that free liquid jet 20 extends nearly to R area 16 before touching any fixed wall. This helps keep fluid friction to a minimum within amplifier 10.

Vapor nozzle 12 preferably surrounds liquid input nozzle 11 and directs a condensable vapor into suction chamber 13 to flow in the same general direction as liquid jet 20. Nozzle 12 constricts vapor flow in a region around input nozzle 11; and this, in cooperation with lower pressure in suction chamber 13, preferably accelerates vapor to at least sonic velocity. This makes vapor flow at a much faster velocity than liquid in jet 20.

As the vapor impinges on liquid jet 20, it perturbs or roughens the jet surface to a frothy consistency that exposes a large surface area of liquid to vapor so that vapor condenses rapidly. The vapor collapses as it condenses and creates a suction that draws in more vapor.

The wall of suction chamber 13 preferably converges downstream at a taper of, for example, 2.5°. The wall can also be parallel or slightly divergent without appreciably diminishing performance. A long and gentle convergence gives jet 20 an adequate length for optimum performance and directs vapor to impinge on jet 20 at a small angle to its direction of travel for effective transfer of momentum from vapor to liquid. The area of the discharge end of suction chamber 13 is preferably equal to or slightly smaller than the area of the entrance to amplifier nozzle 14.

The wall of amplifier nozzle 14 converges toward R area 16, preferably in a long gentle taper of, for example, 5°. Vapor collapses as it condenses in liquid jet 20, and most of the vapor condenses by the time it reaches minimum cross-sectional area 16 so that convergence of amplifier nozzle 14 directs vapor into jet 20 without necessarily increasing vapor pressure.

The length of free liquid jet 20 between discharge area 21 and the impingement of jet 20 on the converging wall of amplifier nozzle 14 is preferably at least 15 times the diameter of R area 16. This ensures that jet 20 is long enough for condensing a substantial portion of the incoming vapor and for accelerating the liquid in response to impingement by the condensing vapor. Jets have operated at lengths of at least 25 times the diameter of R area 16, and I have not yet discovered any upper limit for the jet length.

I have discovered several ways of starting up such a hydrokinetic amplifier so that it can operate on subatmospheric pressure vapor that it draws into suction chamber 13 by the collapse of condensing vapor. This is useful in eductive condensation for evaporation, distillation, or otherwise liquifying a vapor.

The start-up arrangement of FIG. 1 uses an evacuated chamber 25 to initiate flow of subatmospheric pressure, condensable vapor into suction chamber 13. This is done by valved connection between evacuated chamber 25 and gap 17 between suction chamber 13 and amplifier nozzle 14.

Opening valve 26 when suction chamber 13 is in communication with a subatmospheric pressure source 27 of condensable vapor draws vapor into input nozzle 12 and suction chamber 13. Meanwhile, liquid from source 28 is admitted through liquid input nozzle 11 to form liquid jet 20 extending through suction chamber 13 so that inflowing vapor impinges on and condenses in the liquid. The collapse of vapor condensing in liquid jet 20 creates a suction within chamber 13 that draws in more vapor without assistance from evacuated chamber 25. Hydrokinetic amplifier 10 starts up as this occurs and continues operating because the absolute suction pressure from condensing vapor in chamber 13 is less than the subatmospheric pressure of vapor source 27. Valve 26 then closes and both liquid and vapor flow past gap 17 and into amplifier nozzle 14.

Once start-up suction is established in chamber 13, amplifier 10 will continue operating on subatmospheric pressure vapor from source 27. Liquid at subatmospheric pressure from source 28 can also be drawn into suction chamber 13 by the same low pressure produced there from condensing vapor. Also, evacuated chamber 25 can draw both start-up liquid and start-up vapor into suction chamber 13 to bring subatmospheric pressure vapor into contact with subatmospheric pressure liquid so that condensation occurs and produces an operation-sustaining suction within chamber 13.

Start-up necessarily flows some fluid into evacuated chamber 25, and it is desirable to withdraw such fluid and reevacuate chamber 25 to ready it for a subsequent start-up. I prefer doing this by entraining fluid from chamber 25 in a high velocity fluid stream produced by hydrokinetic amplifier 10.

The highest velocity liquid flow within amplifier 10 occurs at R area 16 in amplifier nozzle 14. So I prefer entraining material from chamber 25 in the high velocity fluid flow through R area 16 to reevacuate chamber 25 for reuse on a subsequent start-up. This can be simply done by a line 29 controlled by a valve 30 and leading to R area 16.

After amplifier 10 has started up and established a full velocity flow through R area 16, valve 30 can be opened to evacuate chamber 25 by entraining fluid material from chamber 25 in the high velocity flow through R area 16. This will occur quickly so that valve 30 can be closed after a brief interval, leaving chamber 25 evacuated and ready for use in a subsequent start-up.

The start-up arrangement of FIG. 1 can be made automatic by timing the operation of valves 26 and 30. With amplifier 10 in communication with vapor source 27 and liquid source 28, start-up can be achieved by opening valve 26 for a brief interval and then closing valve 26 followed by opening valve 30 for a brief interval and then closing valve 30.

Figure 2:
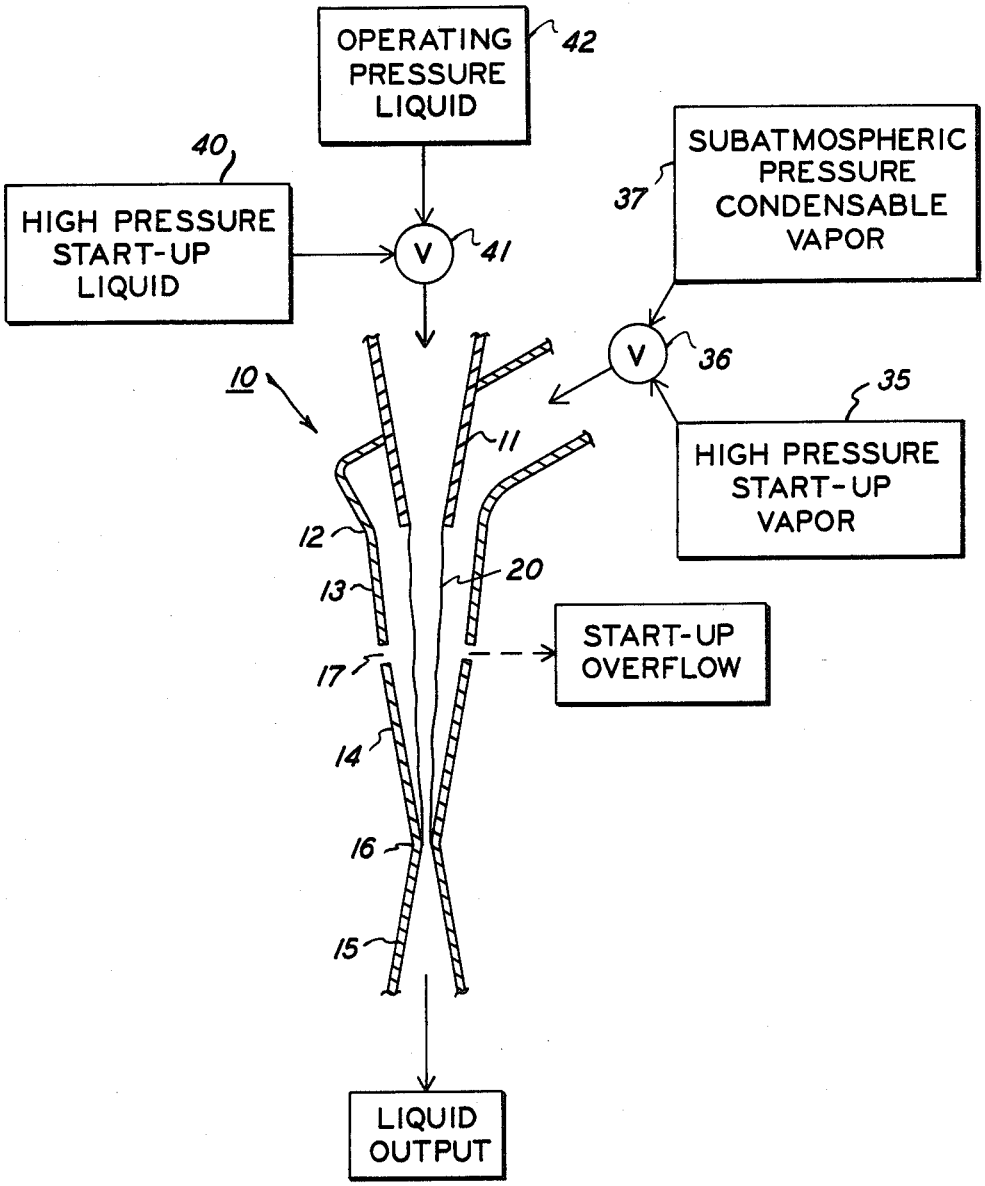

The start-up arrangements of FIG. 2 use a standard start-up overflow from gap 17 if amplifier 10 starts against a back pressure present at the discharge of diffuser 15. Such an overflow preferably has a check valve to block inflow to gap 17 after start-up occurs.

In one mode of start-up for the FIG. 2 arrangement, super atmospheric pressure start-up vapor from a high pressure source 35 is admitted to vapor input nozzle 12 by valve 36 so that start-up vapor contacts liquid jet 20 flowing through suction chamber 13. This causes the start-up vapor to condense in jet 20 and produce a suction in chamber 13 as the vapor collapses. When suction is established, valve 36 switches to a subatmospheric pressure source 37 of condensable operating vapor, which is drawn into chamber 13 by the suction from condensing vapor. Amplifier 10 then continues drawing in and operating on the motive power of vapor from subatmospheric pressure source 37.

An alternative start-up for the arrangement of FIG. 2 is with high pressure start-up liquid from source 40 being directed through liquid input nozzle 11 by valve 41 to form a high velocity jet 20 that produces a low entrainment pressure in suction chamber 13. This draws in subatmospheric pressure vapor from source 37 so that vapor begins condensing in jet 20. The collapse of condensing vapor reduces the pressure further in chamber 13 and draws in more vapor from low pressure source 37. Then valve 41 switches to a source 42 of liquid at a lower operating pressure that can also be subatmospheric. Amplifier 10 continues drawing in liquid and vapor inputs necessary for sustaining operation because of the suction established on start-up from vapor entrained and condensed in the liquid jet in suction chamber 13.

The start-up arrangements of FIGS. 1 and 2 can be applied to either single pass operation, in which liquid and vapor pass once through hydrokinetic amplifier 10, or to feedback operation, in which liquid input to nozzle 11 is drawn from liquid output from diffuser 15. Timers and other controls can be used for operating the necessary valves, and start-up arrangements can be made automatic and unattended.

I claim:

1. A method of starting a hydrokinetic amplifier powered by operating vapor at subatmospheric pressure, said hydrokinetic amplifier having a suction chamber with an input region and a discharge region, a liquid input nozzle arranged in said input region for directing a free liquid jet into said suction chamber, a vapor input nozzle arranged in said input region for directing a vapor into said suction chamber to surround and impinge on said liquid jet, and a converging amplifier nozzle and a diverging diffuser arranged downstream of said suction chamber, said starting method comprising:

a. connecting an evacuated region to said discharge region of said suction chamber while said suction chamber is in communication with a source of said subatmospheric pressure operating vapor so that vapor flows through said vapor input nozzle and into said suction chamber;

b. admitting liquid to said liquid input nozzle to form said free liquid jet extending through said suction chamber while said operating vapor is flowing into said suction chamber so that vapor impinges on and condenses in said liquid jet; and c. disconnecting said evacuated region from said suction chamber once said condensing vapor produces a pressure in said suction chamber lower than the subatmospheric pressure of said operating vapor.

2. The method of claim 1 including connecting said evacuated region to a high velocity fluid flow region of said amplifier nozzle after disconnecting said evacuated region from said suction chamber so that fluid withdrawn into said evacuated region is entrained in said high velocity fluid flow.

3. The method of claim 1 including using a subatmospheric pressure source of liquid entering said liquid input nozzle.

4. A start-up method for a hydrokinetic amplifier powered by operating vapor at subatmospheric pressure, said hydrokinetic amplifier having a suction chamber with an input region and a discharge region, a liquid input nozzle arranged in said input region for directing a free liquid jet into said suction chamber, a vapor input nozzle arranged in said input region for directing a vapor into said suction chamber to surround and impinge on said liquid jet, and a converging amplifier nozzle and a diverging diffuser arranged downstream of said suction chamber, said start-up method comprising:

a. flowing start-up vapor at super atmospheric pressure into said vapor input nozzle;

b. flowing liquid into said liquid input nozzle so that said start-up vapor impinges on and condenses in said free liquid jet to produce a pressure in said suction chamber lower than said subatmospheric pressure of said operating vapor; and c. thereafter changing from said super atmospheric pressure start-up vapor to said subatmospheric pressure operating vapor.

5. A start-up method for a hydrokinetic amplifier powered by operating vapor at subatmospheric pressure, said hydrokinetic amplifier having a suction chamber with an input region and a discharge region, a liquid input nozzle arranged in said input region for directing a free liquid jet into said suction chamber, a vapor input nozzle arranged in said input region for directing a vapor into said suction chamber to surround and impinge on said liquid jet, and a converging amplifier nozzle and a diverging diffuser arranged downstream of said suction chamber, said start-up method comprising:

a. directing pressurized liquid through said liquid input nozzle to form a start-up liquid jet with sufficient velocity to produce a pressure in said suction chamber lower than said subatmospheric pressure of said operating vapor;

b. admitting said operating vapor to said suction chamber so that said vapor impinges on and condenses in said start-up liquid jet to lower the pressure in said suction chamber; and c. thereafter reducing liquid pressure to a lower operational pressure for said free liquid jet.

6. The start-up method of claim 5 including using subatmospheric operational pressure for said liquid entering said liquid input nozzle.

7. A start-up system for a hydrokinetic amplifier powered by operating vapor at subatmospheric pressure, said hydrokinetic amplifier having a suction chamber with an input region and a discharge region, a liquid input nozzle arranged in said input region for directing a free liquid jet into said suction chamber, a vapor input nozzle arranged in said input region for directing a vapor into said suction chamber to surround and impinge on said liquid jet, and a converging amplifier nozzle and a diverging diffuser arranged downstream of said suction chamber, said start-up system comprising:

a. an evacuated chamber;

b. a closable passageway leading from said discharge region of said suction chamber to said evacuated chamber;

c. means for opening said passageway to said evacuated chamber while admitting said subatmospheric pressure vapor to said vapor input nozzle so that vapor flows through said suction chamber;

d. means for admitting liquid into said liquid input nozzle while said passageway is open so that said free liquid jet flows through said suction chamber; and e. means for closing said passageway to said evacuated chamber after flowing vapor in said suction chamber impinges on and condenses in said liquid jet to produce a pressure in said suction chamber lower than said subatmospheric pressure of said operating vapor.

8. The system of claim 7 including a closable return conduit leading from said evacuated chamber to a high velocity fluid flow region of said amplifier nozzle, and means for opening said return conduit after closing said passageway so that fluid withdrawn into said evacuated chamber passes through said return conduit and is entrained in said high velocity fluid flow.

* * * * *